US005687712A

United States Patent [19]

Semeia

[11] Patent Number: 5,687,712

[45] Date of Patent: Nov. 18, 1997

[54] UNDERWATER BREATHING APPARATUS

[75] Inventor: Roberto Semeia, Genoa, Italy

[73] Assignee: Scubapro Europe, S.r.l., Genoa, Italy

[21] Appl. No.: 630,068

[22] Filed: Apr. 15, 1996

[30] Foreign Application Priority Data

Dec. 22, 1995 [IT] Italy ..... MI950879 U

[51] Int. Cl.[6] ..... A62B 7/04

[52] U.S. Cl. ..... 128/205.24; 128/200.29; 128/201.27; 128/201.28; 128/202.27

[58] Field of Search ..... 128/200.29, 201.11, 128/201.12, 201.27, 201.28, 202.27, 204.24, 205.22, 205.24, 204.18; 285/325

[56] References Cited

U.S. PATENT DOCUMENTS 4,328,798 5/1982 Isaacson ..... 128/202.27
4,974,584 12/1990 Goodnoe ..... 128/202.27
5,191,317 3/1993 Toth et al. ..... 128/201.22
5,213,095 5/1993 Dague ..... 128/202.27
5,529,096 6/1996 Rowe, Jr. et al. ..... 128/205.22

FOREIGN PATENT DOCUMENTS 0682007 6/1993 Switzerland ..... 285/325

*Primary Examiner*—U. Millin
*Assistant Examiner*—V. Srivastava
*Attorney, Agent, or Firm*—Kalow, Springut & Bressler

[57] ABSTRACT

Underwater breathing apparatus with improved ease of handling comprises a cylinder, a meter and a quick coupling on the cylinder and on the meter, together with a flexible hose having quick couplings at its ends.

7 Claims, 3 Drawing Sheets

UNDERWATER BREATHING APPARATUS

BACKGROUND OF THE INVENTION

1. Field of the Invention

The present invention relates to underwater breathing apparatus of the type comprising a cylinder and a meter for measuring the pressure inside the cylinder.

2. Description of the Prior Art

In known underwater breathing apparatus, the connections between the flexible hose and the meter are generally formed during the manufacture of the breathing apparatus and are fixed or can be dismantled with suitable tools such as spanners or the like.

The presence of a flexible hose of a certain length is necessary since, whereas the cylinder is fixed on a diver's back, the meter has to be conveniently readable, being carried in front of the diver's underwater mask.

In known breathing apparatus it therefore has to be accepted that when the meter is not in use, it remains suspended from the cylinder or is put away together with the bulky flexible hose.

This exposes the meter, which is generally delicate, to the risk of damage which is all the more to be avoided in view of the fact that these meters, which are often electronic, are quite expensive but are nevertheless essential for the diver's safety.

SUMMARY OF THE INVENTION

The object of the present invention is to provide underwater breathing apparatus which can overcome the disadvantage mentioned with reference to the prior art.

This object is achieved by underwater breathing apparatus of the type specified, characterized in that it comprises a quick coupling comprising a male portion on the cylinder and having a non-return valve, and a female portion on the meter, and a flexible hose having corresponding male and female portions at its ends.

The main advantage of the underwater breathing apparatus according to the invention consists of the fact that it enables the meter to be detached easily from the flexible hose which connects it to the cylinder.

Moreover, for quick checks, the meter can be connected directly to the cylinder without the intermediate flexible hose.

Further characteristics and advantages of the present invention will become clear from the description of the preferred embodiment thereof given by way of non-limiting example, with reference to the appended drawings.

DESCRIPTION OF THE PREFERRED EMBODIMENT

Figure 1:
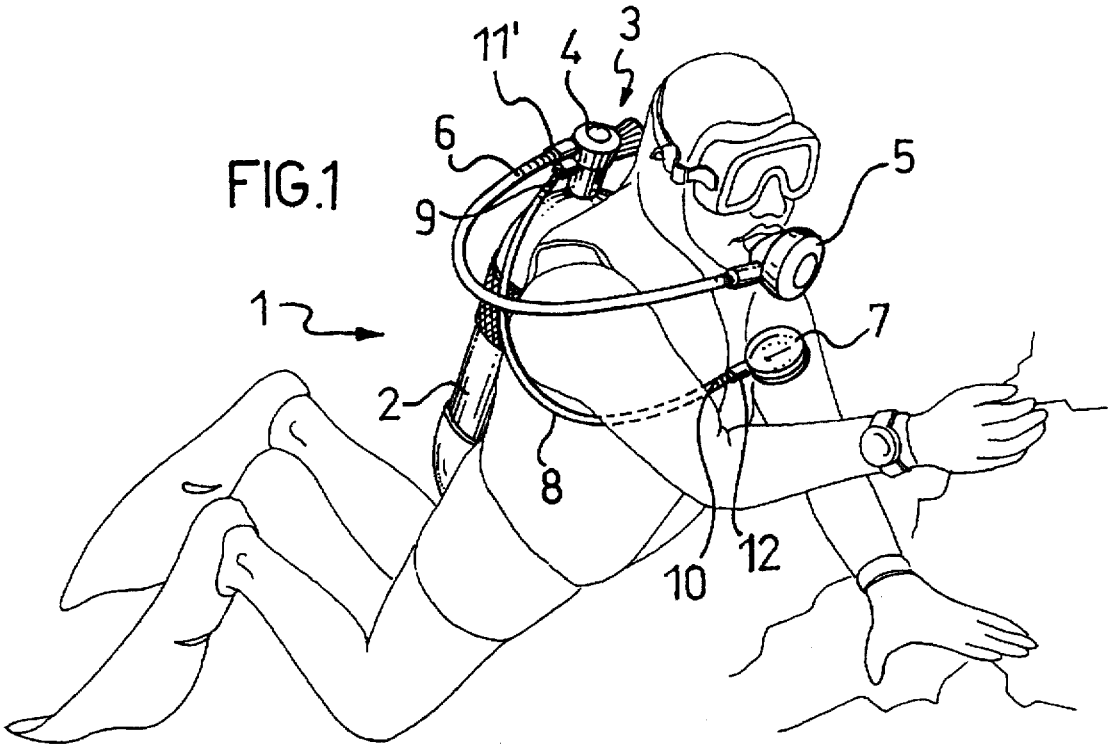
FIG. 1 shows underwater breathing apparatus according to the invention, worn by a diver.
Figure 5:
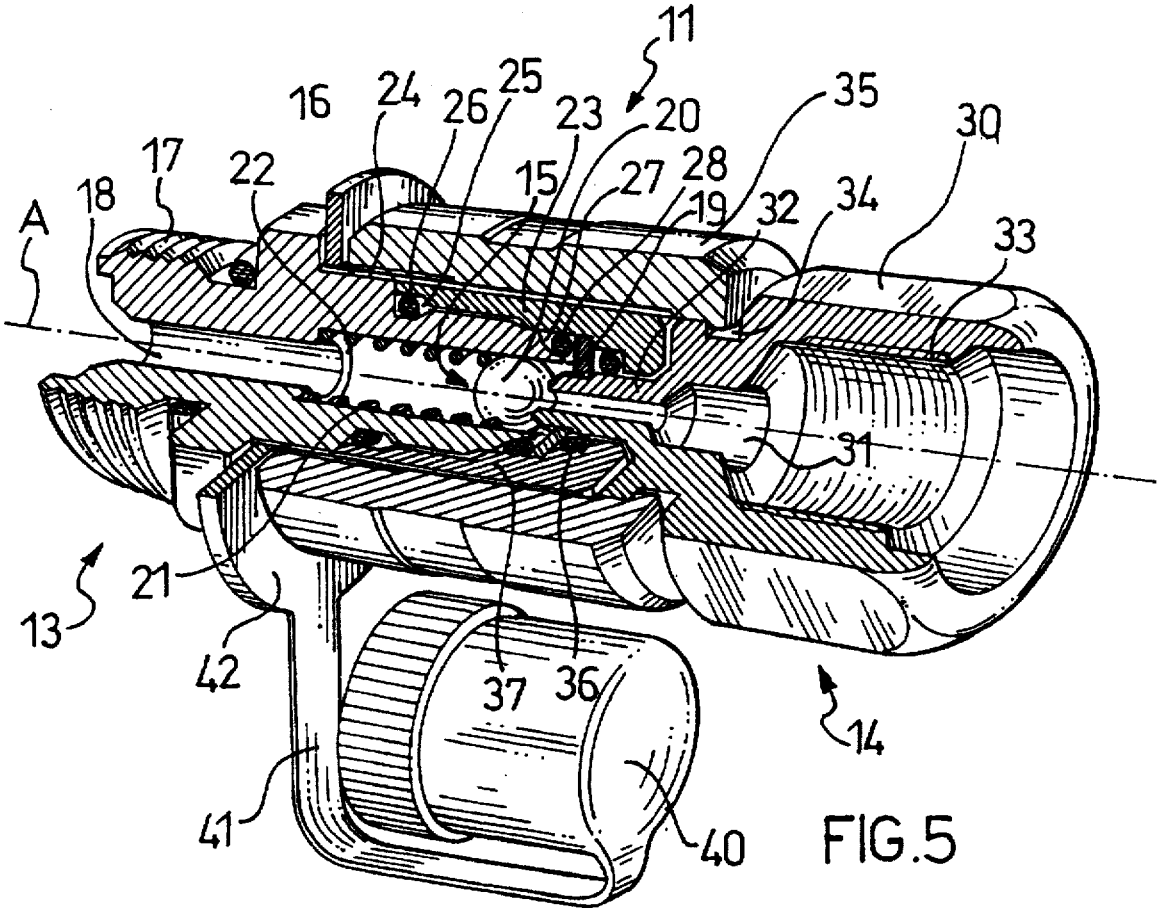
FIG. 5 is a partially longitudinally-sectioned perspective view showing a detail of the part of FIGS. 2, 3 and 4, on an enlarged scale.

In the drawings, underwater breathing apparatus of the type which delivers a breathing mixture, for example air, is indicated 1 and is worn by a diver.

The breathing apparatus 1 comprises a cylinder 2 containing compressed air and an underwater distribution valve 3 which comprises a first stage 4 positioned directly on the cylinder 2, a second stage 5 from which the diver can breathe, and a first flexible hose 6 which connects the first stage 4 and the second stage 5.

The first stage 4 has the function of supplying air to the second stage 5 at a pressure intermediate the storage pressure in the cylinder 2 and the breathing pressure, through the first flexible hose 6.

The breathing apparatus 1 also comprises a meter 7 for measuring the pressure of the compressed air inside the cylinder 2 and a second flexible hose 8 having ends indicated 9 and 10, and connected to the first stage 4 of the distribution valve 3 on the cylinder 2 and to the meter 7, respectively.

Figure 4:
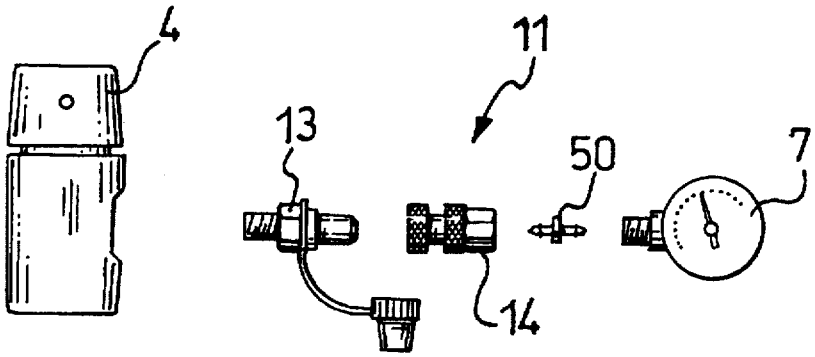
FIG. 4 is another view of the part of FIG. 2.
Figure 6:
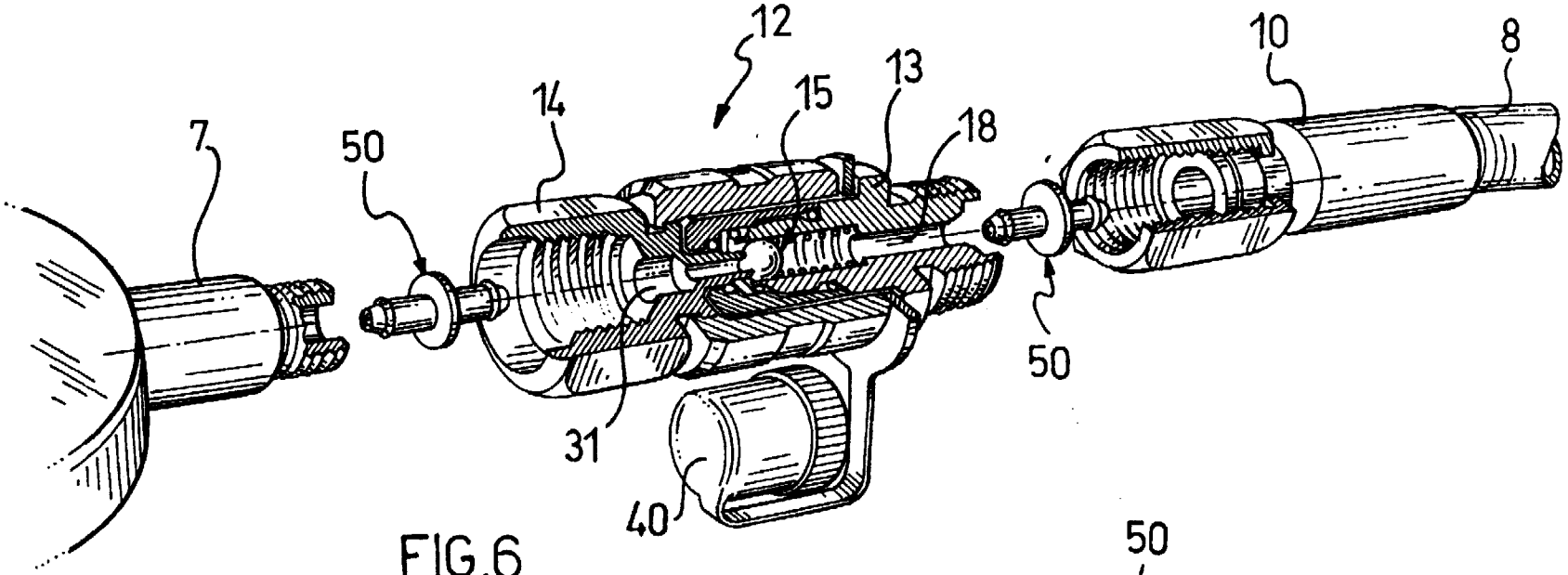
FIG. 6 is a partially longitudinally-sectioned and exploded perspective view of a detail of the part of FIG. 4.

The breathing apparatus 1 comprises a quick coupling 11 (FIG. 4) comprising a male portion 13 on the cylinder 2 and, in particular, on the first stage 4 and a female portion 14 on the meter.

The breathing apparatus 1 also comprises a further male portion 13 on one end 10 of the second hose 8 and a further female portion 14 on the other end 9 of the second hose 8.

When the second flexible hose 8 is interposed between the meter 7 and the cylinder 2 as described above, the breathing apparatus 1 comprises a quick coupling 11' adjacent the cylinder 2 and a quick coupling 12 adjacent the meter (FIG. 1).

As will become clearer from the following description of the quick coupling 11, the male portions 13 contain non-return valves 15.

The male portion 13 of the quick coupling 11 comprises a longitudinal axis A and a valve body 16 which is symmetrical with respect to the axis A and, in its rear region, has a first threaded surface 17 for screwing into the cylinder 2 in a recess thereof, not shown, or into the opposite end 10 of the flexible hose 8 to the cylinder 2.

A first cylindrical duct 18 of axis A extends longitudinally through the valve body 16 and has a hole 19 in the front region of the male portion 13.

The valve body 16 also comprises a ball 20 which is inside the first duct 18 but of smaller diameter, and which obstructs the hole 19 being forced against it by a spring 21 placed under compression between the ball 20 and an abutment surface 22 inside the first duct 18.

At the front, the valve body 16 comprises a cylindrical front end 23 of predetermined diameter holding the ball 20 and the spring 21 and a second threaded surface 24 which is intermediate the front end 23 and the first threaded surface 17 and which has a larger diameter than the front end 23.

The first and second threaded surfaces 17, 24 have respective right-hand and left-hand threads.

Between the second threaded surface 24 and the cylindrical end 23, the valve body 16 comprises an annular cavity 25 which houses a first sealing ring 26.

The valve body 16 further comprises a second annular cavity 27 which houses a second sealing ring 28.

The valve body 16, the first duct 18, the hole 19, the ball 20 and the spring 21 constitute the non-return valve 15 of the male portion 13.

The female portion 14 comprises a cylindrical push rod 30 which is symmetrical with respect to the axis A.

A second duct 31 extends longitudinally through the push rod 30 which comprises a pin 32 for engaging in the hole 19, into which the second duct 31 opens.

At the opposite end to the pin 32, the push-rod 30 also comprises an internal threaded surface 33 for engagement on the meter 7 or on the opposite end 9 of the second flexible hose 8 to the meter 7.

The push-rod 30 comprises an annular groove 34 in which an external bush 35 is rotatably engaged, the bush 35 projecting from the push-rod 30 in order to be screwed onto the second threaded surface 24 forming the quick coupling 11, 11', 12.

The sense in which the valve body 16 is screwed into the cylinder 2 is in any case the opposite of that in which the external bush 35 of the push-rod 30 is unscrewed from the male portion 13.

Upon completion of the screwing-up, the pin 32 is engaged throughout its length inside the hole 19, pushing the ball 20 against the compression force of the spring 21.

A third sealing ring 36 is forced onto the pin 32 and constitutes a stop for an internal bush 37 of the push-rod 30, the internal bush 37 being housed in the external bush 35 and being intended to fit the cylindrical end 23 of the valve body 16 upon completion of the screwing-up of the external bush 35.

When it is fitted on the cylindrical end 23, the internal bush 37 is forced onto the first and second sealing rings 25, 27, also wedging the third sealing ring 36 between it and the cylindrical end 23.

On the valve body 16, the coupling 11 comprises a cap 40 connected to the valve body by means of a band 14 formed integrally with a flexible ring 42 fitted on the second threaded surface 24.

The cap 40 is for fitting on the cylindrical end 23 of the valve body 16.

The first and second ducts 18, 31 formed in the male portion 13 and in the female portion 14, respectively, of the quick couplings 11, 11', 12 advantageously constitute a seat for housing a sealing element 50 of the quick coupling 11.

For this purpose, the diameters of the ducts 18, 31 are equal and their depths are such as to permit this housing.

Figure 7:
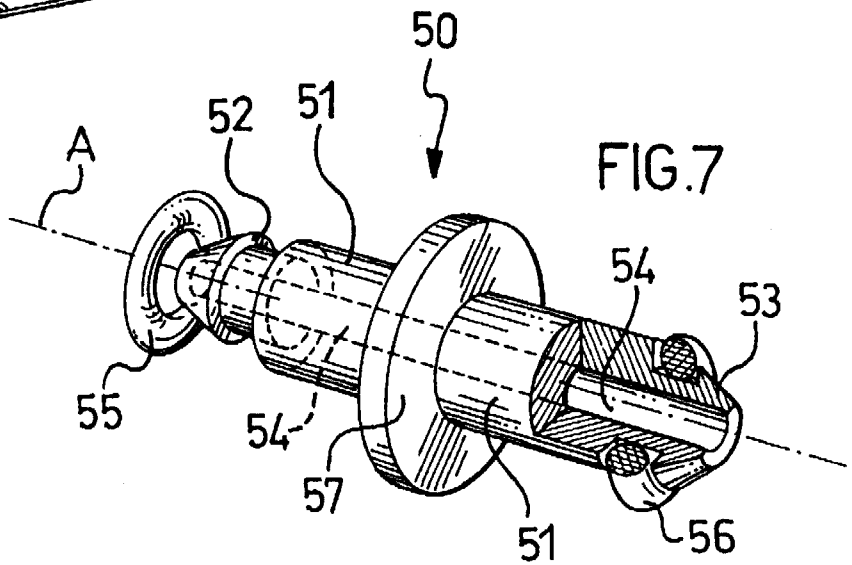
FIG. 7 is a partially longitudinally-sectioned and exploded perspective view of a further detail of FIG. 6.

The sealing element 50 (FIG. 7) comprises a cylindrical body 51 which has respective ends 52, 53 and through which a third duct 54 extends longitudinally.

At the ends 52, 53, the sealing element 50 comprises a fourth sealing ring 55 and a fifth sealing ring 56, respectively, for cooperating with the walls of the ducts 18, 31.

Moreover, the sealing element 50 has a projecting disc-shaped wall 57 positioned centrally and perpendicularly relative to the cylindrical body 51.

Figure 2:
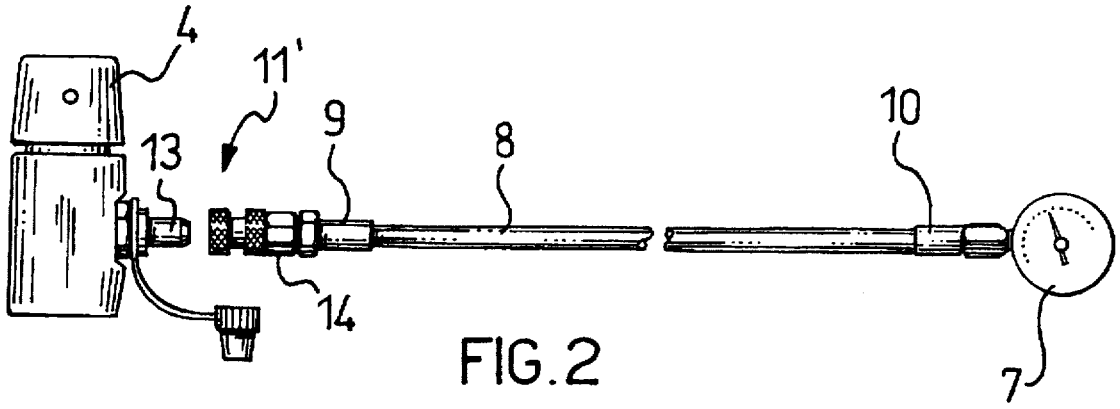
FIG. 2 is a view of a part of the underwater breathing apparatus of FIG. 1.
Figure 3:
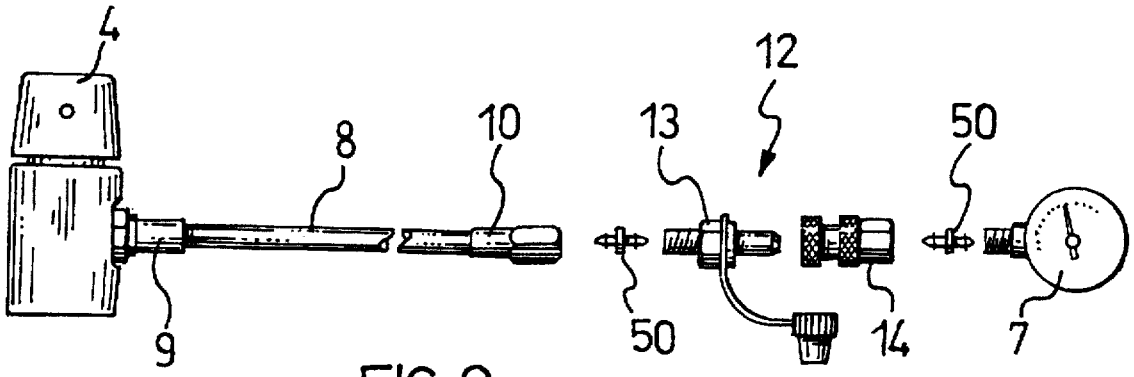
FIG. 3 is another view of the part of the underwater breathing apparatus of FIG. 2.

During normal underwater activity, the meter 7 must continuously provide the required pressure values. For this purpose, the quick couplings 11', 12 on the cylinder 2 (FIG. 2) or on the meter 7 (FIG. 3), respectively, or on both, are closed.

The non-return valves 15 are open since the pins 32 are engaged in the respective actuation holes 19 consequently displacing the balls 20.

The necessary air communication between the cylinder 2 and the meter 7 is thus achieved.

The external and internal bushes 35 and 37 are free to rotate relative to the push-rod 30 of the female portion 14 so that the male portion 13 and the female portion 14 are also free to rotate relative to one another.

The necessary air seal is nevertheless ensured by the presence of the sealing rings 26, 28, 36 and by the sealing element 50, the position of which is described below.

In the quick coupling 11' (FIG. 2), the portion 13 is screwed directly to the first stage 4 and the female portion 14 is connected to the end 9 of the flexible hose 8.

A sealing element 50 interposed between the female portion 14 and the end 9 ensures that the end 9 is completely sealed when the portions 13 and 14 are separated.

In the quick coupling 12 (FIG. 3) the male portion is screwed directly onto the end 10 of the flexible hose 8 and the female portion 14 is connected to the meter 7.

A sealing element 50, interposed between the male portion 13 and the end 10, ensures that the end 10 is completely sealed when the portions 13 and 14 are separated.

Similarly, and for the same purpose, a further sealing element 50 is interposed between the female portion 14 and the meter 7.

When the underwater activity has been completed, it is therefore possible to disconnect both of the quick couplings 11', 12 in order to put the second flexible hose 8 and the meter 7 away in suitable cases.

The cylinder 2 will in any case remain closed by virtue of the non-return valve 15.

For a quick check of the cylinder 2, the meter 7 can also be connected directly to the cylinder 2 without the interposition of the second flexible hose 8.

In this case, in the quick coupling 11 (FIG. 4), the male portion is screwed directly to the first stage 4 and the female portion 14 is connected to the meter 7.

A sealing element 50 interposed between the female portion 14 and the meter 7 ensures that the meter 7 is completely sealed when the portions 13 and 14 are separated.

In addition to the advantage mentioned above, in the underwater breathing apparatus according to the invention, the flexible hose for the meter is not dangerously twisted onto itself.

Moreover, by virtue of the presence of the internal and external bushes, the pin of the female portion is protected from deforming impacts which would render the meter unusable.

Furthermore, accidental unscrewing of the male portion from the cylinder by the unscrewing of the external bush of the female portion is prevented.

Moreover, flexible hoses of different lengths can be used in combination with the same meter to satisfy particular operative requirements.

The underwater breathing apparatus according to the invention is also structurally simple and is easy and cheap to manufacture.

In order to satisfy particular and contingent requirements, an expert in the art may apply to the underwater breathing apparatus described above many variations all of which, however, are included within the scope of protection of the invention as defined by the following claims.

I claim:

1. An underwater breathing apparatus comprising:

(a) a cylinder;

(b) a meter for measuring the pressure inside said cylinder; and (c) a coupling means for attaching said cylinder with said meter, the coupling means comprising a first portion attached to said cylinder and a second portion attached to said meter, said first and second portions being capable of engaging with one another directly or indirectly through a hose so as to couple the cylinder and the meter, and either said first portion or said second portion comprising a non-return valve.

2. The underwater breathing apparatus of claim 1, wherein said coupling means comprises a quick coupling having a male portion, attached to said cylinder and containing said non-return valve, and a female portion attached to said meter, said male portion and female portion being capable of engaging one another.

3. The underwater breathing apparatus of claim 2, wherein each male portion comprises a valve body through which a first duct extends and each female portion comprises a push-rod through which a second duct extends longitudinally, the first and second ducts constituting a seat for housing a sealing element of the quick coupling.

4. The underwater breathing apparatus of claim 3, wherein the sealing element comprises a cylindrical body which has respective ends and through which a further duct extends longitudinally, the sealing element comprising respective sealing rings at the ends for cooperating with the walls of the first and second ducts.

5. The underwater breathing apparatus of claim 2, wherein each male portion comprises a first threaded surface for engagement in the cylinder and a second threaded surface, and that each female portion comprises an external bush for screwing onto the second threaded surface, the first and second threaded surfaces having the same sense of winding of the threads.

6. The underwater breathing apparatus of claim 5, wherein the male portion comprises a valve body which comprises a hole and a cylindrical end adjacent the hole, and the female portion comprises a push-rod which comprises a pin for engaging in the hole and an annular groove in which the external bush is rotatably engaged, the bush projecting from the push-rod in order to be screwed onto the second threaded surface, a sealing ring being forced onto the pin and constituting a stop for an internal bush of the push-rod, the internal bush being housed in the external bush and being intended to fit the cylindrical end of the valve body upon completion of the screwing-up of the external bush.

7. The underwater breathing apparatus of claim 1 further comprising a flexible hose having at one end a connection capable of engaging with said first portion on said cylinder, and at the other end, a second male portion capable of engaging with said female portion on said meter.

* * * * *